US009234401B2

(12) United States Patent
Lawson

(10) Patent No.: US 9,234,401 B2
(45) Date of Patent: Jan. 12, 2016

(54) NESTED CYCLINDER COMPACT BLOWOUT PREVENTER

(75) Inventor: John E. Lawson, South Molton (GB)

(73) Assignee: FMC Technologies, Inc., Houston, TX (US)

( * ) Notice: Subject to any disclaimer, the term of this patent is extended or adjusted under 35 U.S.C. 154(b) by 1125 days.

(21) Appl. No.: 13/138,863

(22) PCT Filed: Apr. 9, 2009

(86) PCT No.: PCT/US2009/002251

§ 371 (c)(1),
(2), (4) Date: Jun. 13, 2013

(87) PCT Pub. No.: WO2010/117350

PCT Pub. Date: Oct. 14, 2010

(65) Prior Publication Data

US 2013/0299724 A1 Nov. 14, 2013

(51) Int. Cl.
*E21B 33/064* (2006.01)
*E21B 33/06* (2006.01)

(52) U.S. Cl.
CPC ..... *E21B 33/064* (2013.01); *E21B 33/063* (2013.01)

(58) Field of Classification Search
CPC ..... E21B 33/06; E21B 33/063; E21B 33/062; E21B 33/064; E21B 33/061
USPC ..... 251/1.3, 1.1
See application file for complete search history.

(56) References Cited

U.S. PATENT DOCUMENTS

| | | | | |
|---|---|---|---|---|
| 3,036,807 | A * | 5/1962 | Lucky et al. | 251/28 |
| 3,379,255 | A * | 4/1968 | Burns, Jr. et al. | 166/55 |
| 5,199,683 | A | 4/1993 | Le | |
| 6,244,560 | B1 | 6/2001 | Johnson | |
| 6,769,350 | B2 * | 8/2004 | Hoogen et al. | 92/51 |
| 7,243,713 | B2 | 7/2007 | Isaacks et al. | |

FOREIGN PATENT DOCUMENTS

EP 1 743 083 B1 2/2008

* cited by examiner

*Primary Examiner* — John K Fristoe, Jr.
*Assistant Examiner* — Andrew J Rost
(74) *Attorney, Agent, or Firm* — Henry C. Query, Jr.

(57) ABSTRACT

A blowout preventer comprises a pair of ram assemblies which are mounted on diametrically opposite sides of a BOP housing. A cylinder-ram is slidably received within each ram assembly and includes a cylindrical cavity. A back plate couples with the outer end of the cylinder-ram and a piston head is positioned in the cavity, forming first and second piston chambers. Hydraulic pressure in the first and second piston chambers forces the cylinder ram from an open position to a closed position, thereby sealing the BOP bore.

14 Claims, 5 Drawing Sheets

NESTED CYCLINDER COMPACT BLOWOUT PREVENTER

BACKGROUND OF THE INVENTION

The present invention relates generally to a compact blowout preventer used in the oil and gas industry. Specifically, the invention relates to a compact blowout preventer featuring a nested cylinder actuator and ram system wherein the overall outer diameter of the device is reduced by combining the ram and actuator cylinder, and increasing the actuator piston area with a second nested cylinder and piston.

Blowout preventers are used in the subsea oil and gas production industry to seal the well bore in the event of a blowout. The blowout preventer ("BOP") may be mounted on a subsea wellhead or christmas tree or located on a surface vessel and connected to the subsea wellhead or christmas tree via a riser. During installation and workover operations, a workover string, such as drill pipe, wireline or coiled tubing, may be lowered through the BOP and into the well bore. In the event of a blowout during any of these operations, the BOP must therefore be able to seal the well bore in the presence of the workover string.

Typical ram-type BOP's normally include an elongated housing, a BOP bore which extends axially through the housing and a pair of opposing BOP rams which are movable laterally across the BOP bore toward and away from each other. The BOP rams are normally actuated by respective pistons which move perpendicular to the BOP bore and are therefore mounted in ram housings which extend laterally from the BOP housing. As a result, these types of BOP's tend to be quite large. For example, one known prior art 10,000 psi surface BOP having a 13⅝" BOP bore comprises an envelope outer diameter of about 120 inches. Such BOP's require that the surface vessel be equipped with a correspondingly large rotary table to enable the BOP to pass through. However, surface vessels of this size are very expensive to operate.

SUMMARY OF THE INVENTION

In accordance with the present invention, these and other limitations in the prior art are addressed by providing a blowout preventer which comprises the novel features described and claimed below.

In one illustrative embodiment of the invention, the blowout preventer comprises an elongated BOP housing, a BOP bore which extends axially through the BOP housing, and a pair of ram assemblies which are mounted on diametrically opposite sides of the BOP housing. Each ram assembly includes a cylinder housing which comprises a generally cylindrical recess that extends generally transversely relative to the BOP bore from a radially inner end of the cylinder housing to a transverse first wall located at a radially outer end of the cylinder housing, a cylinder-ram which is slidably received in the recess and which comprises a generally cylindrical cavity that extends from a radially outer end of the cylinder-ram to a transverse second wall located at a radially inner end of the cylinder-ram, a back plate which is connected to or formed integrally with the outer end of the cylinder-ram, and a piston head which is positioned in the cavity between the second wall and the back plate and is connected to the cylinder housing.

A first piston chamber is defined between the back plate and the first wall, and a second piston chamber is defined between the piston head and the second wall. In operation, application of hydraulic pressure to the first and second piston chambers will move the cylinder ram from an open position in which the cylinder-ram is retracted from the BOP bore to a closed position in which the cylinder-ram extends across the BOP bore to approximately the centerline of the BOP bore.

In accordance with another embodiment of the invention, the second wall comprises a radially inwardly directed front face to which a sealing insert or a shearing insert is connected.

In accordance with yet another embodiment of the invention, the piston head is connected to a support rod which extends through a hole in the back plate and is connected to the first wall.

In a accordance with a further embodiment of the invention, the hydraulic pressure which is used to actuate the cylinder-ram is conveyed from the first piston chamber to the second piston chamber. For example, the hydraulic pressure may be conveyed through a number of fluid passages which extend through the cylinder-ram. In addition, each fluid passage may communicate with the second piston chamber via a corresponding port in the cylinder ram which is located adjacent the front wall. Furthermore, each fluid passage may communicate with the first piston chamber via a corresponding hole which extends through the back plate.

In accordance with another embodiment of the invention, each ram assembly also comprises a third piston chamber which is defined between the piston head and the back plate. Thus, application of hydraulic pressure to the third piston chamber will move the cylinder ram from the closed position to the open position.

The hydraulic pressure for the third piston chamber may be conveyed through a first fluid passage which extends through the piston head. In addition, in the event the piston head is connected to a corresponding support rod which extends through a hole in the back plate and is connected to the cylinder housing, the hydraulic pressure may be conveyed through a second fluid passage which extends through the support rod and is connected to the first fluid passage.

Thus, the cylinder-ram is moved from its open position to its closed position not only by pumping hydraulic fluid into the first piston chamber, but also by conveying this hydraulic fluid into the second piston chamber. In this manner, a combined actuating force is generated on the cylinder-ram. A first actuating force is generated by the application of hydraulic pressure between the back plate and the cylinder housing. A second actuating force is generated by the application of the hydraulic pressure between the front wall and the internal piston head (which is connected to the cylinder housing). This combined force is substantially greater than can be achieved in prior art pistons of similar size. In effect, the combined force is equivalent to a force generated by application of the hydraulic pressure to a single piston having the combined area of the front wall and the back plate.

Also, the unique design of the ram assemblies of the present invention effectively reduces the outer diameter envelope of the BOP. The combined actuating force acting on the cylinder-ram is achieved through the use of a piston actuator which comprises a nested cylinder arrangement. In this arrangement, the cylinder housing defines a first cylinder and the cylinder-ram defines a second cylinder which is nested within the first cylinder. As a result, the BOP is capable of shearing relatively large diameter workover strings without requiring a correspondingly large outer diameter envelope.

These and other objects and advantages of the present invention will be made apparent from the following detailed description, with reference to the accompanying drawings.

DETAILED DESCRIPTION OF THE INVENTION

Figure 1:
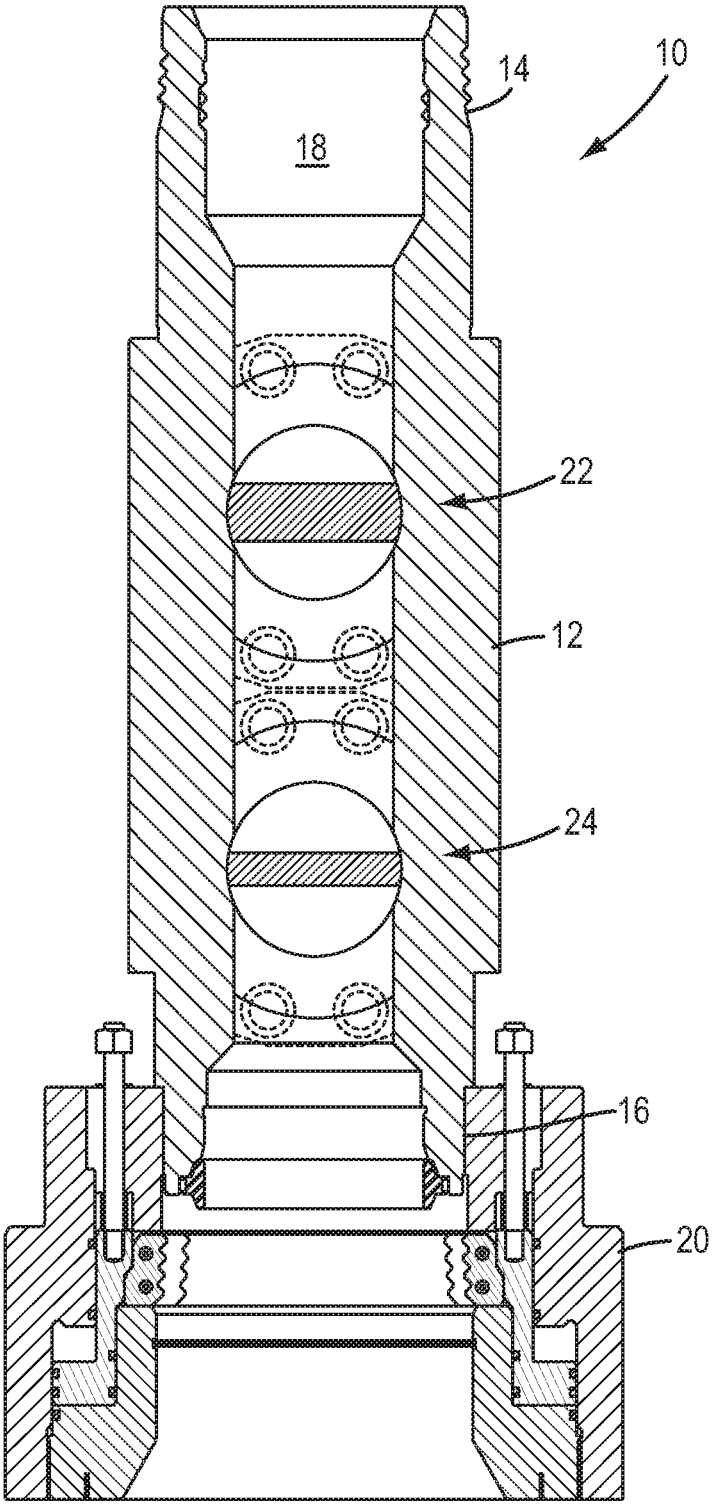
FIG. 1 is a cross-sectional view of an illustrative embodiment of the BOP of the present invention comprising both a blind ram assembly and a shear ram assembly.

Referring to FIG. 1, an exemplary embodiment of the BOP of the present invention is indicated generally by reference number 10. The BOP 10 includes an elongated BOP housing 12 which comprises an upper end 14, a lower end 16 and a BOP bore 18 which extends axially from the upper end to the lower end. The lower end 16 is shown attached to a conventional connector 20 which may be used to secure the BOP 10 to a subsea production or workover component (not shown).

Figure 2:
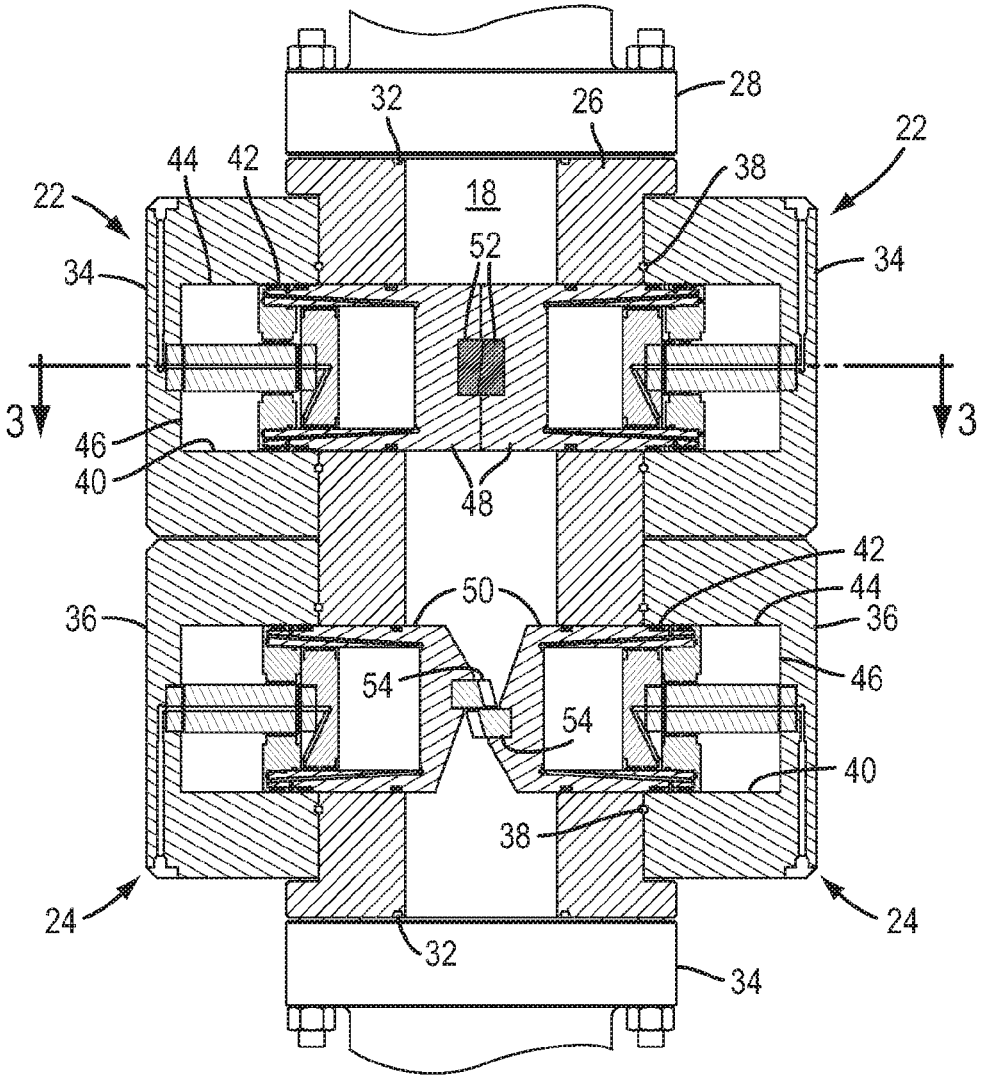
FIG. 2 is an enlarged cross-sectional view of the blind ram and shear ram assemblies of FIG. 1 shown rotated 90 degrees.
Figure 3:
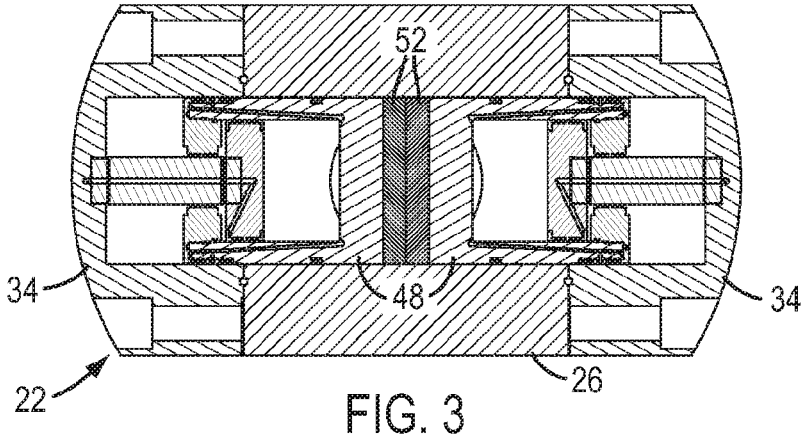
FIG. 3 is a top cross-sectional view of the blind ram assembly taken along line 3-3 of FIG. 2.

Referring also to FIGS. 2 and 3, the BOP 10 includes a number of ram assemblies, such as a pair blind ram assemblies 22 and a pair of shear ram assemblies 24. The ram assemblies of each pair are mounted on diametrically opposite sides of the BOP housing 12 or, as shown in FIG. 2, on diametrically opposite sides of a spool piece 26. The spool piece 26 is connected between an upper housing portion 28 and a lower housing portion 30 and is sealed to the BOP housing 12 by suitable seals 32. For purposes of the following description, the spool piece 26 should be considered to be part of the BOP housing 12.

Each ram assembly 22, 24 comprises a corresponding cylinder housing 34, 36 which is bolted or otherwise connected to the BOP housing 12 and is sealed to the BOP housing by an appropriate seal 38. Each cylinder housing 34, 36 comprises a cylindrical recess 40 which extends transversely relative to the BOP bore from a radially inner or front end 42 to a radially outer or rear end 44 that is closed by a transverse rear wall 46. In the context of this description, the terms "radially inner" and "radially outer" denote locations which are relative to the centerline of the BOP 10. Thus, the radially inner or front end 42 is the end of the recess 40 closest to the centerline of the BOP 10, and the radially outer or rear end 44 is the end of the recess farthest from the centerline of the BOP.

In use, the BOP 10 is mounted to a subsea production or workover assembly which is installed over the well bore. In the event of a blowout, the BOP 10 must be able shear any workover string which may be present in the BOP bore 18 and then seal the BOP bore. Accordingly, each ram assembly 22, 24 includes a pair of cylinder-rams which are capable of shearing a workover string and/or sealing the BOP bore 18.

In the illustrative embodiment of the invention shown in the Figures, for example, the blind ram assembly 22 includes a pair of blind cylinder-rams 48 and the shear ram assembly 24 includes a pair of shear cylinder-rams 50. A sealing insert 52 is mounted on a radially inner portion of each blind cylinder-ram 48, and a shearing insert 54 is mounted on a radially inner portion of each shear cylinder-ram 50. Thus, in the event of a blowout, the blind cylinder-rams 48 will close and seal against each other to thereby seal off the BOP bore 18. In addition, if a workover string is present in the BOP bore, the shear cylinder-rams 50 will close and shear the workover string and then seal against each other to thereby seal the BOP bore.

In accordance with the present invention, each cylinder-ram 48, 50 is moved into its closed position by a piston actuator which comprises a nested cylinder arrangement. As will be described more fully below, the cylinder housing 34, 36 defines a first cylinder and the corresponding cylinder-ram 48, 50 defines a second cylinder which is nested within the first cylinder. As a result, the BOP 10 is capable of shearing relatively large diameter workover strings without requiring a correspondingly large cylinder housing.

With the exception of the radially inner portions of the cylinder-rams 48, 50, the nested-cylinder piston actuators, and indeed the ram assemblies 22, 24, are substantially similar. For purposes of brevity, therefore, the piston actuators and the corresponding portions of the ram assemblies 22, 24 will be described with reference to only the right-hand portion of the shear ram assembly 24, which is depicted in FIG. 4.

Figure 4:
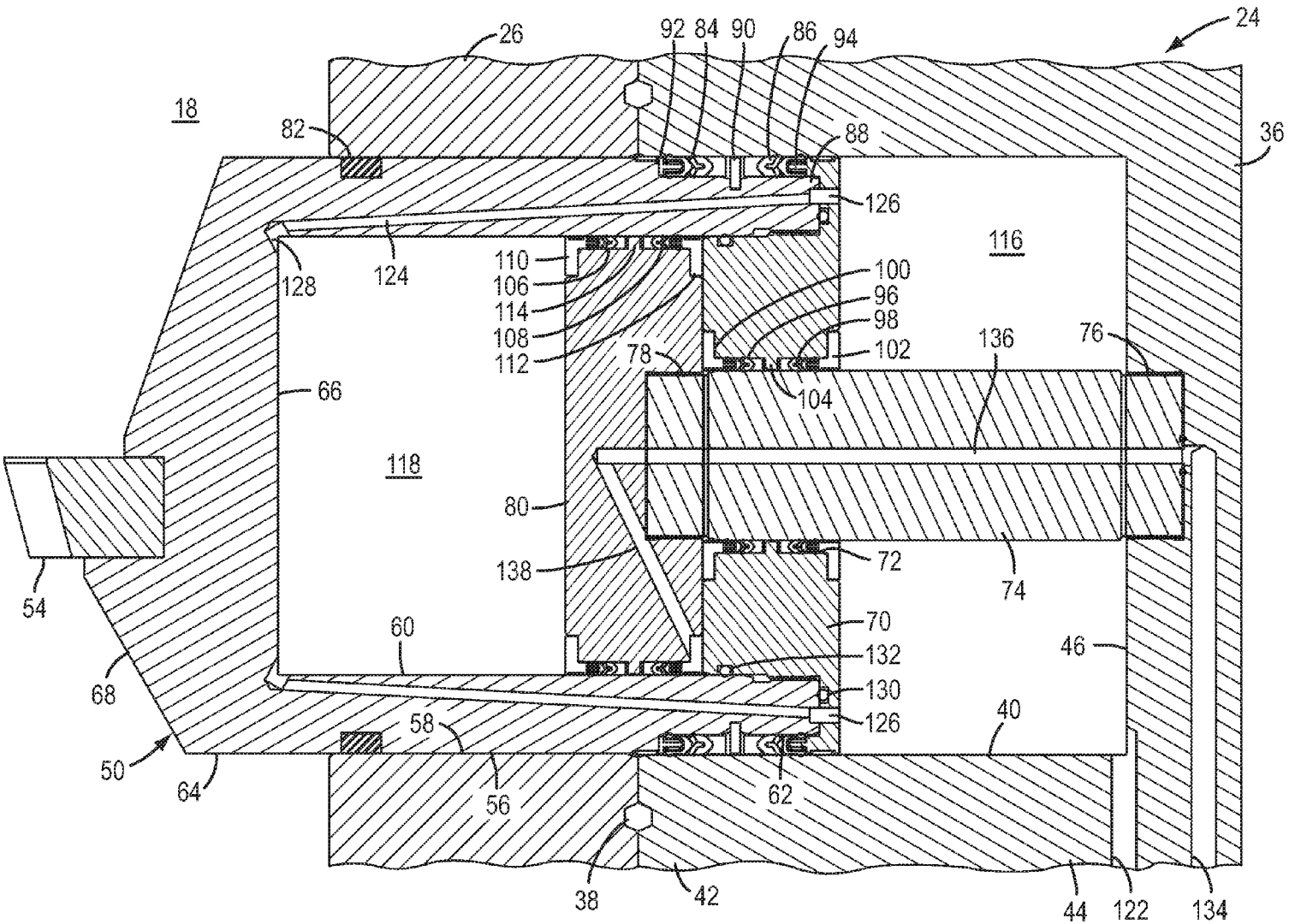
FIG. 4 is an enlarged cross-sectional view of the shear ram shown on the right-hand side of FIG. 2.

As shown in FIG. 4, each shear cylinder-ram 50 comprises a cylindrical ram body 56 which is slidably received within the recess 40 of the cylinder housing 36 and a similarly sized transverse bore 58 in the spool piece 26. The ram body 56 comprises cylindrical cavity 60 which extends transversely relative to the BOP bore from a radially outer or rear end 62 to a radially inner or front end 64 that is closed by a transverse front wall 66. The front wall 66 includes a radially inner or front face 68 to which the shearing insert 54 is connected by suitable means. For example, the shearing insert 54, which may be a conventional component, may be secured within a corresponding slot in the front face 68 by a number of screws (not shown). Alternatively, the shearing function provided by the shearing insert 54 may be incorporated into a differently-configured component which is connected to or formed integrally with the cylinder-ram 50, as is common in any of a variety of existing BOP rams. The sealing inserts 52 may be mounted to the blind cylinder-rams 48 in a manner similar to the shearing insert 54.

In addition to the sealing inserts 52 and the shearing inserts 54, it should be understood that other types of inserts may be used with the cylinder-rams, depending on the function which one desires the BOP 10 to perform. For example, a pipe sealing insert may be connected to or incorporated into the cylinder-rams in a manner described above to form a pipe cylinder-ram. Furthermore, a combination of shearing, sealing or pipe sealing inserts may be incorporated into the cylinder-rams. For example, a shearing insert and a pipe sealing insert may be incorporated into a single cylinder-ram to both seal against and shear a workover pipe, or a shearing insert and a sealing insert may be incorporated into a single cylinder-ram to both shear a workover pipe and seal the BOP bore above the sheared end of the pipe. Other combinations of functionalities are also possible. The manner of incorporating multiple inserts into a single cylinder-ram will be readily understood by the person of ordinary skill in the art from the teachings contained herein.

A disc-shaped back plate 70 is formed integrally with or, as shown in the drawings, secured such as by threads to the rear end 62 of the cylinder-ram 50. The back plate 70 includes a transverse hole 72 through which a support rod 74 extends. The support rod 74 comprises a radially outer end 76 which is connected to the rear wall 46 of the cylinder housing 36 and a radially inner end 78 which is connected to an inner piston head 80 that is slidably received in the cavity 60 of the ram body 56.

The cylinder-ram 50 is sealed to the bore 58 of the spool piece 26 and to the recess 40 of the cylinder housing 36 by suitable means. For example, the cylinder-ram 50 may be sealed to the bore 58 by a conventional seal 82 and to the recess 40 by a pair of inner and outer packings 84, 86. The packings 84, 86 are positioned on a reduced diameter portion 88 of the ram body 56 and are separated by a retainer ring 90 which is secured to the ram body in a conventional fashion.

The inner packing 84 is retained between the retainer ring 90 and a shoulder 92 which is defined by the inner end of the reduced diameter portion 88, and the outer packing 86 is retained between the retainer ring and a T-ring 94 which is connected to or formed integrally with the back plate 70.

Similarly, the back plate 70 and the inner piston head 80 are sealed by suitable means to the support rod 74 and the cavity 60 of the ram body 56, respectively. For example, The back plate 70 may be sealed to the support rod 74 by a pair of inner and outer packings 96, 98 which are retained in place on the back plate by a pair of inner and outer gland nuts 100, 102 and are separated by a spacer ring 104 which is formed integrally with the back plate. Similarly, the inner piston head 80 may be sealed to the cavity 60 by a pair of inner and outer packings 106, 108 which are retained in position on the piston head by a pair of inner and outer gland nuts 110, 112 and are separated by a spacer ring 114 which is formed integrally with the piston head.

Figure 5:
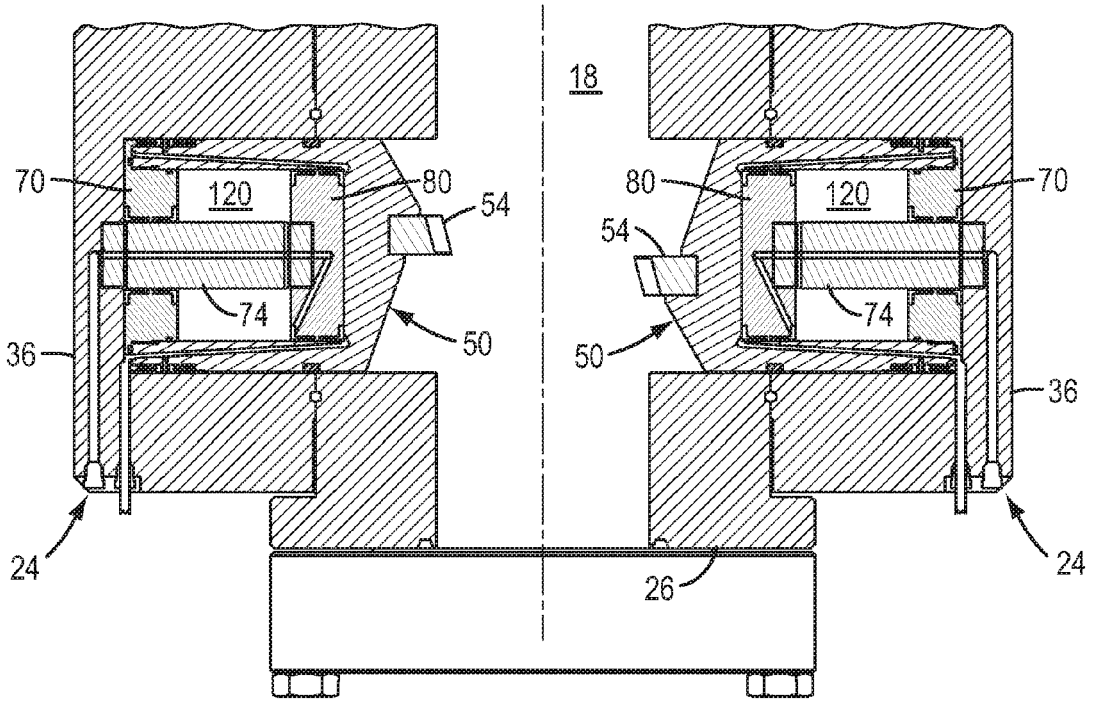
FIGS. 5 through 8 are sequential cross-sectional views of the shear ram assembly of FIG. 2 shown at various stages from its fully open position to its fully closed position.

In this manner, the portion of the recess 40 which is bounded by the back plate 70 and the rear wall 46 defines a first piston chamber 116 for the cylinder-ram 50, the portion of the cavity 60 which is bounded by the front wall 66 and the inner piston head 80 defines a second piston chamber 118 for the cylinder-ram, and the portion of the cavity which is bounded by the back plate 70 and the inner piston head 80 defines a third piston chamber 120 for the cylinder-ram (FIG. 5).

The first piston chamber 116 is connected to a first source of hydraulic fluid (not shown) by a first fluid passage 122 that extends through the cylinder housing 36. The second piston chamber 118 is preferably also connected to the first source of hydraulic fluid, ideally via the first piston chamber 116. Thus, the ram body 56 includes a number of second fluid passages 124, each of which extends between a corresponding through hole 126 in the back plate 70 and a port 128 located adjacent the front wall 66. A first seal 130 and preferably also a second seal 132 may be provided between the back plate 70 and the ram body 56 to isolate the holes 126 from the third piston chamber 120.

In accordance with the present invention, the cylinder-ram 50 is moved from its open position (FIG. 5) to its closed position (FIG. 4) not only by pumping hydraulic fluid into the first piston chamber 116, but also by conveying this hydraulic fluid into the second piston chamber 118 via the through holes 126 and the second fluid passages 124. In this manner, a combined actuating force is generated on the cylinder-ram 50. A first actuating force is generated by the application of hydraulic pressure on the back plate 70. This force acts to push the back plate 70, and thus the cylinder-ram 50, away from the rear wall 46 of the cylinder housing 36. A second actuating force is generated by the application of the hydraulic pressure on the front wall 66 of the cylinder-ram 50. This force acts to push the cylinder-ram 50 away from the internal piston head 80 (which is secured to the cylinder housing 36 via the support rod 74). The combination of these first and second actuating forces results in a relatively large resultant force acting to drive the cylinder-ram 50 into its closed position.

The combined force generated by the application of hydraulic fluid to the back plate 70 and the front wall 66 is substantially greater than can be achieved in prior art pistons of similar size. In effect, this combined force is equivalent to a force generated by application of the hydraulic pressure to a single piston having the combined area of the front wall 66 and the back plate 70. Moreover, since the piston actuator comprises a nested cylinder arrangement of the cylinder housing 36 and the cylinder-ram 50, the length of the piston actuator is substantially smaller than in conventional prior art designs. As a result, the BOP 10 is capable of shearing relatively large diameter workover strings without requiring a relatively large outer diameter envelope.

The third piston chamber 120 is preferably connected to a second source of hydraulic fluid (not shown) by a third fluid passage 134 which extends through the cylinder housing 36, a fourth fluid passage 136 which extends through the support rod 74 between the third fluid passage and the inner piston head 80, and a fifth fluid passage 138 which extends through the piston head from the fourth fluid passage to the third piston chamber. When it is desired to move the cylinder-ram 50 from its closed position back to its open position, hydraulic fluid is pumped into the third piston chamber 120, which will force the back plate 70, and thus the cylinder-ram, toward the rear wall 46 of the cylinder housing 36.

It should be noted that, although the second source of hydraulic fluid may be separate from the first source of hydraulic fluid, the first and second sources may in fact be the same source. In this event, the first and third fluid passages 122, 134 would be connected to separate lines of a hydraulic circuit that is supplied by the common source of hydraulic fluid.

The operation of the shear ram assembly 24 will now be described with reference to FIGS. 5 through 8. In the unactivated condition of the BOP 10, the shear cylinder-rams 50 are in the open or retracted position shown in FIG. 5. In the event of a blowout, hydraulic fluid is pumped into the first piston chambers 116 to force the back plates 70, and thus the cylinder-rams 50, away from the rear walls 46. At the same time, hydraulic fluid is conveyed from the first piston chambers 116 to the second piston chambers 118 in the manner described above to created an additional force which pushes the cylinder-rams 50 away from the internal piston heads 80.

Figure 6:
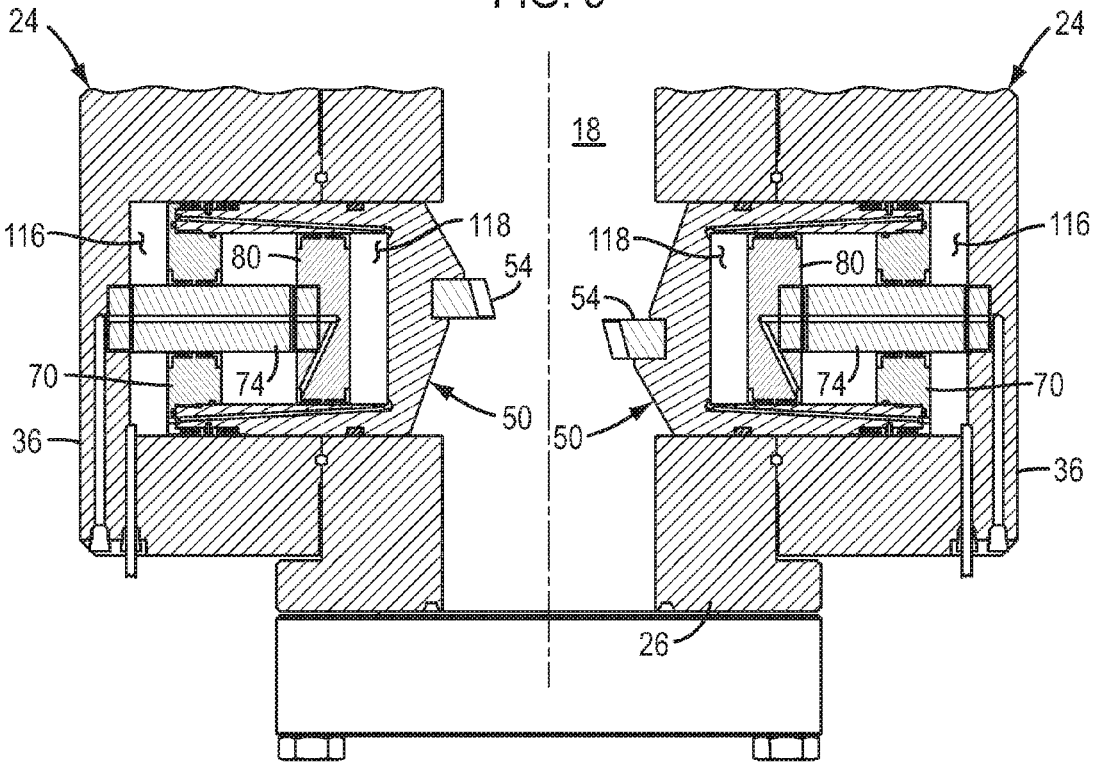
Figure 7:
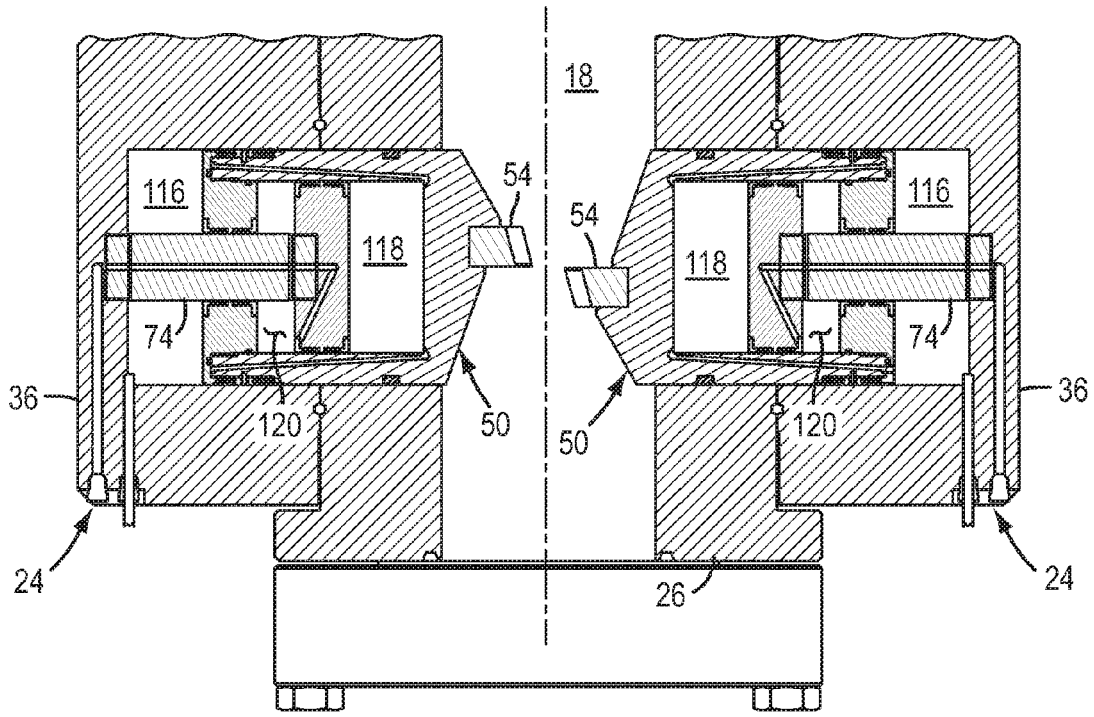
Figure 8:
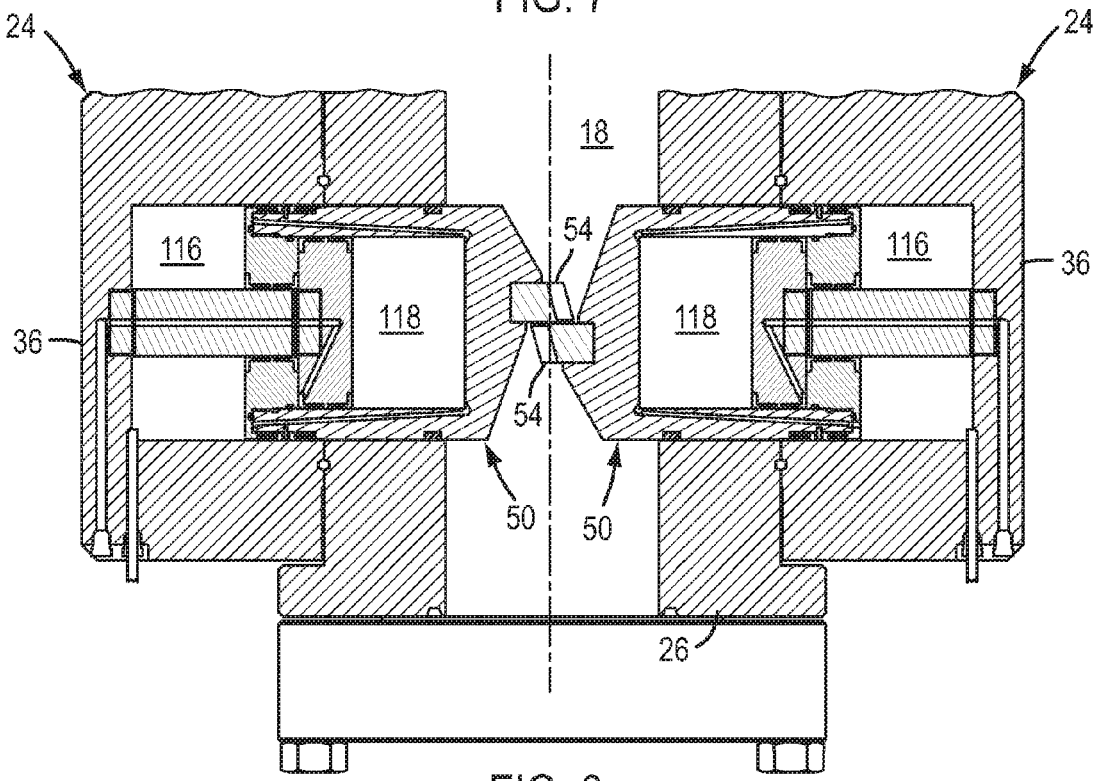

The application of hydraulic pressure to the first and second piston chambers 116, 118 will thus force the cylinder-rams 50 radially inwardly from the open position shown in FIG. 5, through the intermediate positions shown in FIGS. 6 and 7, and into the closed position shown in FIG. 8. In this position, the shearing inserts 54 have severed any workover string that may have been in the BOP bore 18 and are forced by the bore pressure into sealing engagement with each other to thereby seal off the BOP bore 18.

In order to retract the cylinder-rams 50 from the closed position to the open position, hydraulic fluid is pumped into the third piston chamber 120. This will created a force which will push the back plates 70 away from the internal piston heads 80 and thereby move the cylinder-rams 50 radially outwardly towards the rear walls 46 of the cylinder housings 36.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A blowout preventer which comprises:

an elongated BOP housing;

a BOP bore which extends axially through the BOP housing; and a pair of ram assemblies which are mounted on diametrically opposite sides of the BOP housing, each ram assembly comprising:

a cylinder housing which comprises a recess that extends generally transversely relative to the BOP bore from a radially inner end of the cylinder housing to a transverse first wall located at a radially outer end of the cylinder housing;

a cylinder-ram which is slidably received in the recess and which comprises a cavity that extends from a radially outer end of the cylinder-ram to a transverse second wall located at a radially inner end of the cylinder-ram;

a back plate which is connected to or formed integrally with the outer end of the cylinder-ram, the cylinder-ram being sealed to the cylinder housing proximate the back plate;

a piston head which is positioned in the cavity between the second wall and the back plate and is sealed to the cylinder-ram, the piston head being connected to the cylinder housing;

a first piston chamber which is defined between the back plate and the first wall; and a second piston chamber which is defined between the piston head and the second wall;

wherein application of hydraulic pressure to the first and second piston chambers will move the cylinder ram from an open position in which the cylinder-ram is retracted from the BOP bore to a closed position in which the second wall of the cylinder ram extends across the BOP bore to approximately the centerline of the BOP bore.

2. The BOP of claim 1, wherein the second wall comprises a radially inwardly directed front face to which a sealing insert is connected.

3. The BOP of claim 1, wherein the second wall comprises a radially inwardly directed front face to which a shearing insert is connected.

4. The BOP of claim 1, wherein the second wall comprises a radially inwardly directed front face to which a pipe sealing insert is connected.

5. The BOP of claim 1, wherein the second wall comprises a radially inwardly directed front face to which a combination of at least two of a sealing insert, a shearing insert and a pipe sealing insert are connected.

6. The BOP of claim 1, wherein the piston head is connected to a support rod which extends through a hole in the back plate and is connected to the first wall.

7. The BOP of claim 1, wherein the hydraulic pressure is conveyed from the first piston chamber to the second piston chamber.

8. The BOP of claim 7, wherein the hydraulic pressure is conveyed through a number of fluid passages which extend through the cylinder-ram.

9. The BOP of claim 8, wherein each fluid passage communicates with the second piston chamber via a corresponding port in the cylinder ram which is located adjacent the front wall.

10. The BOP of claim 8, wherein each fluid passage communicates with the first piston chamber via a corresponding hole which extends through the back plate.

11. The BOP of claim 1, wherein each ram assembly further comprises:

a third piston chamber which is defined between the piston head and the back plate;

wherein application of hydraulic pressure to the third piston chamber will move the cylinder ram from the closed position to the open position.

12. The BOP of claim 11, wherein the hydraulic pressure is conveyed through a first fluid passage which extends through the piston head.

13. The BOP of claim 12, wherein the piston head is connected to a corresponding support rod which extends through a hole in the back plate and is connected to the cylinder housing, and wherein the hydraulic pressure is conveyed through a second fluid passage which extends through the support rod and is connected to the first fluid passage.

14. The BOP of claims 1, further comprising a second pair of ram assemblies which are mounted on diametrically opposite sides of the BOP housing.

* * * * *